US007775187B2

(12) United States Patent
Boucard et al.

(10) Patent No.: US 7,775,187 B2
(45) Date of Patent: Aug. 17, 2010

(54) HEAD OF A GLOW PLUG PROVIDED WITH A PRESSURE SENSOR

(75) Inventors: Michel Boucard, Tournefeuille (FR); Bernd Last, Reutlingen (DE); Cyrille Patri, Toulouse (FR); Alain Ramond, Merville (FR); John Burrows, Cheshire (GB); Sandro Goretti, Rubiera (IT)

(73) Assignees: Continental Automotive France, Toulouse (FR); Federal-Mogul Ignition Srl, Carpi (MO) (IT)

( * ) Notice: Subject to any disclaimer, the term of this patent is extended or adjusted under 35 U.S.C. 154(b) by 402 days.

(21) Appl. No.: 11/587,653

(22) PCT Filed: Apr. 19, 2005

(86) PCT No.: PCT/FR2005/000933

§ 371 (c)(1),
(2), (4) Date: Feb. 23, 2007

(87) PCT Pub. No.: WO2005/111502

PCT Pub. Date: Nov. 24, 2005

(65) Prior Publication Data

US 2007/0227486 A1 Oct. 4, 2007

(30) Foreign Application Priority Data

Apr. 27, 2004 (FR) ..... 04 04465

(51) Int. Cl.
*F02P 23/00* (2006.01)
*F02B 9/08* (2006.01)

(52) U.S. Cl. ..... 123/143 R; 123/145 A

(58) Field of Classification Search ..... 123/143 R, 123/145 A, 153, 143 C
See application file for complete search history.

(56) References Cited

U.S. PATENT DOCUMENTS

| | | | | | |
|---|---|---|---|---|---|
| 3,971,264 | A * | 7/1976 | Detraz et al. | 74/424.87 |
| 4,341,992 | A * | 7/1982 | Goldstein | 324/693 |
| 4,652,261 | A * | 3/1987 | Mech et al. | 604/130 |
| 5,269,284 | A * | 12/1993 | Pujos et al. | 124/88 |
| 5,557,888 | A * | 9/1996 | Ruchat et al. | 49/362 |
| 5,878,501 | A * | 3/1999 | Owens et al. | 30/286 |
| 6,056,237 | A * | 5/2000 | Woodland | 244/3.15 |
| 6,152,095 | A * | 11/2000 | Ripma et al. | 123/169 R |
| 6,363,898 | B1 * | 4/2002 | Ripma et al. | 123/169 R |
| 6,658,942 | B1 * | 12/2003 | Faesch | 73/781 |
| 7,064,816 | B2 * | 6/2006 | Langenbacher et al. | 356/128 |
| 7,290,351 | B2 * | 11/2007 | Niarfeix | 33/645 |
| 2004/0125363 | A1 * | 7/2004 | Langenbacher et al. | 356/128 |
| 2005/0210627 | A1 * | 9/2005 | Luebbering et al. | 15/410 |

FOREIGN PATENT DOCUMENTS

| | | |
|---|---|---|
| DE | 102 49 706 A1 | 5/2004 |
| EP | 1096141 A2 | 5/2001 |
| JP | 59060237 | 4/1984 |
| JP | 59134341 | 8/1984 |
| JP | 04 260719 | 1/1993 |

* cited by examiner

*Primary Examiner*—John T Kwon
(74) *Attorney, Agent, or Firm*—Young & Thompson

(57) ABSTRACT

A glow plug includes a glow plug body (2), a pressure sensor arranged inside the glow plug body (2), a threaded portion (6) on the outside of the glow plug body (2) and gripping elements (12), generally of cylindrical form with a hexagonal section, enabling the body (2) to be gripped and screwed into a corresponding tapping, the gripping elements (12) being made from synthetic material.

19 Claims, 2 Drawing Sheets

HEAD OF A GLOW PLUG PROVIDED WITH A PRESSURE SENSOR

Figure 2:
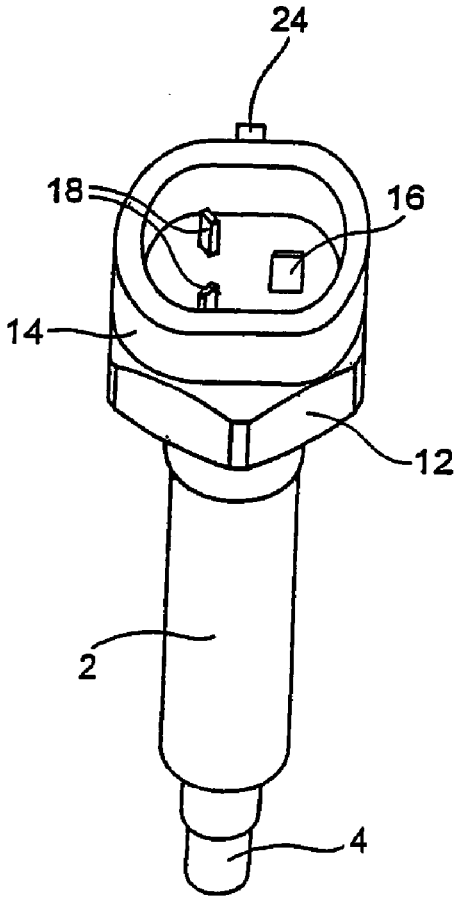

The present invention concerns a glow plug head equipped with a pressure sensor

In an internal combustion engine, in particular a Diesel type engine, it is known to mount a glow plug at each cylinder. This glow plug is generally screwed into a cylinder head. It usually comprises a tubular body having on its outer surface a threaded portion enabling it to be fixed into a corresponding bore formed in the cylinder head. Once the body has been mounted in its bore, a portion thereof is located within the combustion chamber and another portion, referred to as glow plug head, is located externally thereof. The portion within the combustion chamber bears a finger within which is located a heater electrode. This electrode is supplied by a core which passes through the tubular body of the glow plug and is itself supplied with electrical energy from a connector located generally in the glow plug head.

In known manner, a pressure sensor can be placed in the head of such a glow plug. This sensor is provided for measuring the pressure within the corresponding combustion chamber. The knowledge of that pressure enables better regulation of the engine by optimizing the efficiency thereof and by reducing its consumption. By virtue of this sensor, it is also possible to have a less polluting engine.

The fact of housing a pressure sensor in the glow plug head, in addition to the connector supplying the core of the glow plug with electrical energy, makes it necessary to have a glow plug head of large size. This increases first of all the cost of that glow plug and secondly the mass of the glow plug head. More particularly, the body of the sensor is entirely machined. The maximum diameter of that body is located at the head, at the location provided with a gripping zone, generally hexagonal, used for the screwing/unscrewing of the glow plug. By increasing the diameter of the glow plug head in this way, the diameter of this gripping zone is thus also increased and this leads to a rise in the machining costs.

It has furthermore been noted that the high mass of the glow plug head could generate vibrations liable to hinder the pressure measurement made by the sensor located within the glow plug head.

The present invention is thus directed to providing a glow plug equipped with a pressure sensor of which the production cost is limited. Preferably, the head of this glow plug will have a mass that is not very high and will not perturb the pressure measurement made by the sensor located within it.

To that end, the invention provides a glow plug comprising a glow plug body, a pressure sensor arranged inside the glow plug body, a threaded portion on the outside of the glow plug body and gripping means, generally of cylindrical form with a hexagonal section, enabling the body to be gripped and screwed into a corresponding tapping.

According to the invention, the gripping means are formed of synthetic material.

In this way, the portion of the body adapted to hold the various components of the glow plug and to enable them to be mounted in a threaded bore may have a smaller diameter. Usually, as stated above, the body of a glow plug integrates a portion of hexagonal section to facilitate the screwing of the glow plug and is entirely machined from a circular cylindrical metal bar. The diameter of the bar used is determined by the diameter of the cross-section of the gripping zone. The solution provided by the invention makes it possible to limit the diameter of the bar of raw material used to produce the body (generally of steel) of the glow plug and thus the production cost of that body by limiting especially the cost of the machining operations. The synthetic material used may be polyamide such as PA 6.6 or PA 6.12.

Advantageously, the gripping means form an overmolding of the pressure sensor and of the body of the glow plug. In this way, these gripping means formed of synthetic material effectively protect the pressure sensor against all external attack.

A glow plug according to the invention may further comprise a heater electrode, connecting means for the electrical energy supply to the heating electrode and for transmitting the signal output by the pressure sensor. In this case those connection means are advantageously overmolded in order to be protected.

A first variant embodiment of such a glow plug may provide for the connection means to form a male connector which form a single part with the gripping means whereas another variant may provide for the connection means to be connected to electrical wires, and that those wires project from the overmolded portion of the glow plug body.

For a better link between the gripping zone and the body of a glow plug according to the invention, the glow plug body has for example adjacent the gripping means striations over at least a portion of its periphery. If the body is a tubular body, the striations are for example oriented longitudinally so as to transmit a screwing (or unscrewing) couple optimally.

The present invention also concerns an internal combustion engine which comprises a glow plug as described above.

Figure 1:
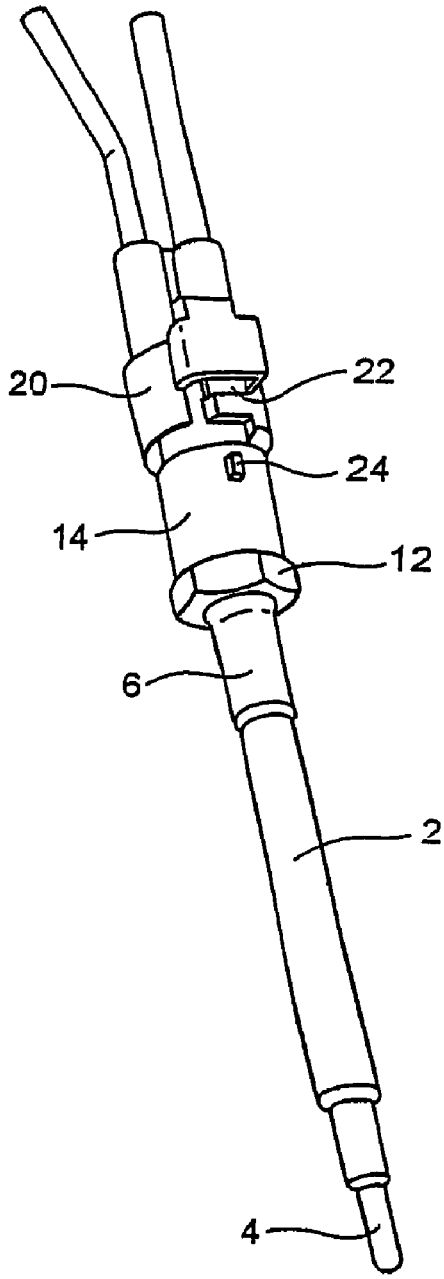
Figure 3:
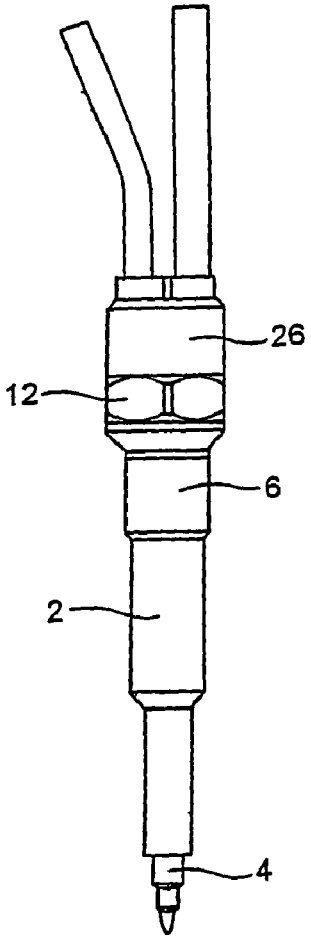
Figure 4:
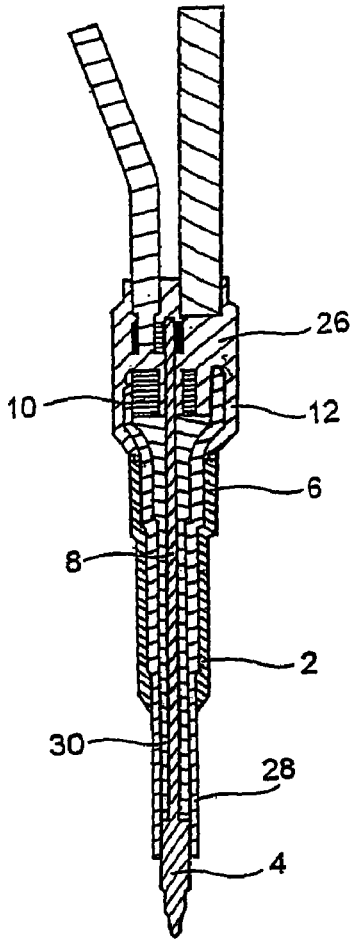
Figure 5:
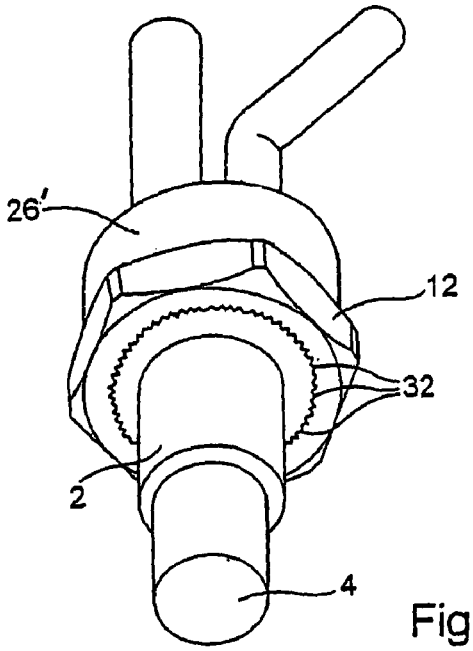

Details and advantages of the present invention will appear more clearly from the following description, made with respect to the accompanying drawings in which:

FIG. 1 represents a perspective view of a glow plug according to the invention as well as a female connector, FIG. 2 shows the glow plug of FIG. 1 from another angle and at an enlarged scale, FIG. 3 shows a side view of another glow plug according to the invention, FIG. 4 shows the glow plug of FIG. 4 in longitudinal cross-section, and FIG. 5 is a perspective view of a third embodiment of a glow plug according to the invention.

In a conventional manner, all the glow plugs represented in the drawings comprise a body 2 and a finger 4.

The body 2 is a generally circular cylindrical tubular part. On its outer surface it has a threaded zone 6 making it possible to fix the body and the glow plug assembly associated with that body, in a threaded bore. In this way, the glow plug may be fixed in the cylinder head of an internal combustion engine, in particular a Diesel type engine.

The body 2 carries the finger 4. When the glow plug is mounted on a cylinder head, the finger 4 is located within a combustion chamber. Inside that finger, there is to be found, in known manner, a heater electrode (not shown) supplied with electrical energy by a core 8 (FIG. 4) passing through the tubular body 2.

On the opposite end from the finger 4, the glow plug carries a pressure sensor 10 for measuring the ambient pressure in the corresponding combustion chamber. The pressure sensor 10 is generally a piezo-electric sensor. It measures the force exerted by the gas pressure within the combustion chamber on the finger 4.

In the embodiment of FIG. 1, the head of the glow plug, that is to say the portion of that glow plug located at the opposite end from the finger 4, is produced of synthetic material. Viewed from the exterior, it has two portions, a first portion forming a gripping zone 12 and a second portion forming a male connector 14. The synthetic material used for producing the head of the glow plug may be a polyamide such as PA 6.6 or PA 6.12.

The gripping zone 12 extends onwards from the body 2, is coaxial with respect to the body 2 and has a hexagonal cross-section. This gripping zone 12 is fixed to the body 2. It is for example overmolded onto that body 2. The gripping zone 12 is used for the screwing and unscrewing of the glow plug. The tightening couples for such a glow plug are compatible with producing the gripping zone 12 from synthetic material.

The connector 14 forming the second portion of the glow plug head enables the electrical connection of the glow plug to the exterior. This connection makes it possible to supply the heater electrode of the finger 4 with electrical energy and to transmit the signal measured by the piezo-electric pressure sensor 10. This connector thus has three contacts: a first contact 16 connected to the core 8 of the glow plug (the return path being via earth) and two other contacts 18 each connected to a collector of the piezo-electric pressure sensor 10 (cf. FIG. 2).

This male connector 14 is adapted to receive a corresponding female connector 20. The latter is for example, as shown in FIG. 1, provided with a bayonet fixing system 22. The corresponding male connector 14 then comprises a lug 24 on its outer surface cooperating with the fixing system 22 of the female connector 20. Two electrical wires lead from the female connector 20, one corresponding to the energy supply of the heater electrode of the finger 2 and the other corresponding to the transmission of the signal from the pressure sensor 10.

In this embodiment, the pressure sensor 10 is located in the glow plug head and is overmolded with synthetic material forming the gripping zone 12 and the connector 14.

FIGS. 3 and 4 show a variant embodiment of a glow plug according to the invention. In this embodiment, the glow plug head is also formed by overmolding the end of the body 2 with synthetic material. In this glow plug head there are once again found the pressure sensor 10 and means for connecting that sensor and the core 8. On its outer surface, the glow plug head also has a gripping zone 12. The difference with respect to the glow plug of FIGS. 1 and 2 is that here the male and female connectors are grouped together into a single part. Electrical wires are then directly fixed, for example by soldering, onto contacts of the pressure sensor 10 and/or onto the core 8. The pressure sensor 10, the means for connecting the sensor 10 and the core 8 as well as the upper portion of the body 2 are thus overmolded with synthetic material to form a one-piece head 26. Over at least a portion of its height, the outer surface of that one-piece head 26 has a hexagonal cross-section. Two wires project from that one-piece head 26: one corresponding to the electrical energy supply of the core 8 and the other to the transmission of the signal obtained on making the pressure measurement by the pressure sensor 10. Of course, in most cases, a connector (or two separate connectors) are to be found at the free end (not shown) of the wires connected to the glow plug head.

FIG. 4 shows the glow plug of FIG. 3 in longitudinal cross-section. This Figure thus shows the various components within the glow plug. This is a non-limiting example, given purely by way of illustration, of the interior structure of a glow plug according to the invention. It is to be noted here that the invention may apply to all types of glow plug comprising a pressure sensor, whatever the manner used to transmit the forces exerted by the ambient pressure in a combustion chamber on the pressure sensor.

In the embodiment of FIG. 4, the body 2 carries a tubular intermediate part 28 on which the finger 4 is mounted. This tubular intermediate part 28 is intended to isolate the finger 4 from the body 2.

The finger 4 has an interference fit with the lower end of the tubular intermediate part 28. The latter also is fixed by an interference fit to the lower end of the body 2.

The tubular intermediate part 28 passes through the whole body 2. Adjacent the head of the glow plug, this tubular intermediate part 28 has a flared formation in which the pressure sensor 10 is housed.

The gas pressure within the combustion chamber exerts forces on the finger 4. These forces are passed on to the sensor via a spacer 30, formed for example of ceramic material.

As is apparent from FIG. 4, the overmolding of synthetic material forming the one-piece head 26 is well held onto the head 2 in particular by virtue of the flared formation formed on the tubular intermediate part 28. This flared formation forms a shoulder against which the one-piece head 26 bears and which prevents the withdrawal of that head.

FIG. 5 shows a variant embodiment of a glow plug according to the invention which provides, by other means than those described above with reference to FIG. 4, excellent holding of the portion formed of synthetic material. In this embodiment represented in FIG. 5 there is once again a one-piece head 26' from which two electrical wires project.

In the embodiment of FIG. 5, the body 2, which is for example made from steel, has on its upper portion (i.e. adjacent the head of the glow plug) a zone having longitudinal striations 32 on its outer periphery. These striations thus form grooving which promotes excellent rotational driving of the body 2 by the one-piece head 26' when a tightening (or unscrewing) couple is exerted on that head, in particular at the gripping zone 12.

All the embodiments described above makes it possible to obtain a glow plug equipped with a pressure sensor at a lower production cost that the glow plugs of the prior art that are also provided with such a sensor. In those glow plugs, the head which generally houses the pressure sensor is of a relatively large diameter. The body of the glow plug, in the prior art glow plugs, is formed from steel by machining. At the start a cylindrical bar is thus used of which the diameter corresponds to the diameter of the head of the glow plug. A high machining cost thus results. As can be seen in particular in FIGS. 4 and 5, the diameter of the body 2 is substantially less than the outer diameter of the head of the glow plug. The fact of having thus used synthetic material to form the gripping zone enabling the screwing and unscrewing of the glow plug in a corresponding threaded bore makes it possible to substantially reduce the diameter of the bar of raw material used for forming the body of that glow plug.

In addition to the reduced cost that the use of synthetic material allows for the production of the gripping zone, the use of synthetic material at the head of the glow plug enables other important advantages to be obtained.

Thus the use of synthetic material makes it possible to reduce the mass of the head of the glow plug. This is because the density of the synthetic material is less in comparison with that of the steel usually used for forming the head. Thus reduction in mass is favorable to a better measurement of the pressure by the pressure sensor which is located inside that head. This is because the head of the glow plug is subject to vibrations during the operation of the engine in which it is mounted. These vibrations may be at the origin of noise in the signal recorded by the pressure sensor. By reducing the mass of the head of the glow plug, the particular frequency of the vibrations of the head of the glow plug are moved away from the bandwidth of the pressure sensor. The vibrations of the head of the glow plug transmitted to the sensor do not then perturb the measurements made by that sensor.

The overmolding of the sensor and of the connection means also make it possible to provide excellent fluid-tightness with respect to the sensor and those connections. The overmolding thus provides protection for the sensor which makes it possible to increase its reliability and its life.

The present invention is not limited to the embodiments described above by way of non-limiting example. It also concerns all the variant embodiments accessible to the person skilled in the art.

The invention claimed is:

1. A glow plug, comprising:

a glow plug body (2) formed of a first material with a threaded portion (6) formed on an outside of the glow plug body (2);

a glow plug head formed of a second material connected to a first end of the glow plug body (2), an exterior of the glow plug head forming a gripping means (12);

a finger (4) extending from an opposite second end of the glow plug body (2); and a pressure sensor (10) arranged inside the glow plug head;

wherein the gripping means (12) of the glow plug head has a generally of cylindrical form with a hexagonal section, the gripping portion being grippable to turn the glow plug in a corresponding tapping, and wherein the second material of the glow plug head is a synthetic material.

2. The glow plug according to claim 1, wherein the synthetic material is overmolded over the pressure sensor (10) and onto the first end of the glow plug body.

3. The glow plug according to claim 1, wherein the finger (4) comprises a heating electrode, and wherein the glow plug head further comprises connecting means, formed of the synthetic material, for the electrical energy supply to the heating electrode and for transmitting the signal output by the pressure sensor (10).

4. The glow plug according to claim 3, wherein the connecting means comprises a male connector (14) forming a single part with the gripping means (12).

5. The glow plug according to claim 3, wherein the connecting means comprise electrical wires, and wherein said electrical wires project from the glow plug head.

6. The glow plug according to claim 1, wherein the glow plug body (2) has striations (32) over at least a portion of a periphery of the glow plug body (2) adjacent the gripping means (12) of the glow plug head.

7. The glow plug according to claim 6, wherein the body (2) is a tubular body, and wherein the striations (32) are longitudinally oriented.

8. The glow plug according to claim 1, wherein the first material is a metal.

9. The glow plug according to claim 8, wherein the first material is steel.

10. The glow plug according to claim 1, wherein the glow plug head is formed as one piece of the synthetic material.

11. The glow plug according to claim 1, wherein a portion of the synthetic material of the glow plug head encircles an outer periphery of the first end of the glow plug body (2) to secure the glow plug head to the glow plug body.

12. The glow plug according to claim 1, further comprising:

a tubular intermediate part (28) inside and coaxial with the glow plug body and having a flared formation at one end, wherein the tubular intermediate part (28) extends into the glow plug head such that the synthetic material of the glow plug head holds the flared formation to secure the glow plug head to the glow plug body (2).

13. An internal combustion engine, comprising:

at least one glow plug, wherein each of said at least one glow plug comprises a glow plug body (2) formed of a first material with a threaded portion (6) formed on an outside of the glow plug body (2), a glow plug head formed of a second material connected to a first end of the glow plug body (2) with an exterior of the glow plug head forming a gripping means (12), a finger (4) extending from an opposite second end of the glow plug body (2), and a pressure sensor (10) arranged inside the glow plug head wherein the gripping means (12) of the glow plug head has a generally of cylindrical form with a hexagonal section, the gripping portion being grippable to turn the glow plug in a corresponding tapping, and wherein the second material of the glow plug head is a synthetic material.

14. The internal combustion engine according to claim 13, wherein the engine is of the Diesel engine type.

15. The internal combustion engine according to claim 13, wherein the first material is a metal.

16. The internal combustion engine according to claim 15, wherein the first material is steel.

17. The internal combustion engine according to claim 13, wherein the glow plug head is formed as one piece of the synthetic material.

18. The internal combustion engine according to claim 13, wherein a portion of the synthetic material of the glow plug head encircles an outer periphery of the first end of the glow plug body (2) to secure the glow plug head to the glow plug body.

19. The internal combustion engine according to claim 13, further comprising:

a tubular intermediate part (28) inside and coaxial with the glow plug body and having a flared formation at one end, wherein the tubular intermediate part (28) extends into the glow plug head such that the synthetic material of the glow plug head holds the flared formation to secure the glow plug head to the glow plug body (2).

* * * * *